United States Patent [19]

Marabotto

[11] 4,331,059

[45] May 25, 1982

[54] ACCOMPANYING DEVICE FOR PLAYING STRINGED INSTRUMENTS

[76] Inventor: Jose Marabotto, Mar Atlantico 144, Neptuno-Monterrico, Lima, Peru, 33

[21] Appl. No.: 167,487

[22] Filed: Jul. 11, 1980

[51] Int. Cl.[3] ..... G10D 3/00

[52] U.S. Cl. ..... 84/317; 84/318

[58] Field of Search ..... 84/315, 317–319, 84/326, 443

[56] References Cited

U.S. PATENT DOCUMENTS 2,132,281 10/1938 Adamson ..... 84/317

2,669,151 2/1954 Maccaferri ..... 84/317

*Primary Examiner*—Lawrence R. Franklin

*Attorney, Agent, or Firm*—Birch, Stewart, Kolasch & Birch

[57] ABSTRACT

An accompanying device for attachment to the neck of a string instrument, such as a guitar, for assisting in the playing of the selected chords to conform to a complete tone or melody. The device comprises a container and a group of selector keys contained therein which are spaced at operational heights above the strings. Each selector has a number of elongations to reach the strings and engage them at the corresponding frets.

7 Claims, 11 Drawing Figures

ACCOMPANYING DEVICE FOR PLAYING STRINGED INSTRUMENTS

This invention relates to a chord forming apparatus for a musical instrument and more specifically to an accompanying device for stringed instruments with enough versatility to play any kind of music, accompany any singing voice regardless of the range and to fit any guitar.

Guitars are commonly used in folk music to form chords for accompanying a singer. In much of this music, a melody can be accompanied by the sounding of chords and the prior art is repleat with chord playing attachments that comply with this purpose to various degrees of effectiveness. For example, U.S. Pat. No. 4,154,134 relates to a chord playing attachment for stringed instruments, such as guitars and the like, wherein combinations of string depressors are pressed down on the strings to produce a chord. The string depressors are connected with a spring action to a component which is attached to the instrument. U.S. Pat. No. 4,030,400 discloses an apparatus for exerting pressure on several strings of a stringed instrument simultaneously by operation of a push button which transmits either hydraulically, pneumatically or by flexible cable, the touch of a single push button to several strings of a stringed instrument for purposes of producing a chord of music. U.S. Pat. No. 3,915,051 discloses a chord playing attachment for stringed musical instruments with combination attachment mounting and spacer brackets positioned at the four corners of the attachment and adjustably mounted for width adjustment for different neck widths. The attachment mounts different height keys for ease of fingering. U.S. Pat. No. 3,805,664 teaches a chord selector for a stringed musical instrument comprising a support carriage adapted for attachment to a musical instrument, a plurality of string depressors mounted on the support carriage movable between positions not engaging the strings of the musical instrument and positions engaging the strings. A plurality of selector keys mounted on the support carriage and an operating assembly connecting the selector keys and the string depressors and responsive to the movement of any one of the selector keys to more selectively the string depressors whereby a preselected musical chord may be produced on the instrument is disclosed. Other references are available which relate to chord playing attachments which like the above disclosures are complex in nature and not readily adaptable to all forms of music and are strictly limited as chord playing attachments which restricts the scope of their effectiveness in a musical environment.

It is therefore an object of the present invention to provide a music accompanying device which will overcome the above noted disadvantages.

It is a further object of the present invention to provide a music accompanying device which due to the nature of its design provides a capability for producing a multitude of note variations.

Still another object of the present invention is to provide a means for accompanying musical tones with a high degree of selectivity and precision so as to obtain chords upon a string instrument easily and rapidly over a broad range of musical notes.

Yet still another object of the present invention is to provide a simplified music accompanying device which provides for a variety of musical chords capable of producing a broad scope of musical tones.

The foregoing objects and others are accomplished in accordance with the present invention, generally speaking, by providing a device which is easily mounted on the neck of a string instrument, such as a guitar, simply and without harm or modification to the respective instrument. The accompanying device has standardized dimensions in order to fit different measurements with respect to the string and fret separations along the same neck and is interchangeable between necks of different string instruments. The accompanying device comprises eight selector keys installed into a container which maintains them at an operating height above the strings of the particular instrument. The device is portable and small in size and its keyboard is easy to reach and comfortable to use. The selector keys are easy to operate and light to the touch and conveniently and efficiently disposed within the container. The accompanying device is capable of producing nine chords obtainable by means of the eight selector keys and a non-keyed chord. Each selector has a number of elongations which when pushed down engage the strings juxtapositioned to the corresponding fret such that a variety of tones may be achieved for a specific string and fret setting. When one selector is depressed its movement will not interfere with any of the other selectors in the configuration. When released, it returns to its original position by a spring action further discussed below. Many varieties of tones may be achieved by installing the accompanying device at different heights along the neck of the string instrument. The accompanying device provides for the availability of seven complete families of organized tones or groups of chords, each one integrated by the above stated musically interrelated and coherent nine chords by installing the device at different heights along the neck of the instrument. Furthermore, five additional tones of the harmonic spectrum are available by just changing the tonic tone from C to G, each being formed by not less than seven chords. The accompanying device as stated above brings seven complete families of nine chords each, and the resonant four families of the spectrum, with six chords each. The chords produceable according to the present invention cover generally the complete harmonic spectrum, twelve tones each one formed by nine chords functionally placed in order to present an easy to operate device that is readily compatible with any singing voice tone or pitch and that can be applied to substantially any kind of music. The accompanying device of the present invention requires absolutely no musical aptitude in order to play the necessary accompaniments pursuant to a given musical interlude.

The above-mentioned device is fabricated along strict specifications. The total height of the keys must not exceed one inch above the strings. All keys must be reachable without moving the hand along the neck. The keys must measure about $\frac{3}{4}$ inch to $\frac{1}{2}$ inch and be disposed in the manner prescribed by the illustrations so as to conform to the movement of the fingers and more particularly the strongest three fingers. The selector keys are clearly identifiable to the user and the amount of pressure to depress the key is quite small, corresponding to the small contact area of each key with the strings. The selector device of the present invention is very simple in nature having no complicated mechanisms, each key having a number of elongations directly stopping strings with no intermediate or separate pieces, with its overall volume and weight considered less than that of a cigarette pack. It is durable and inexpensive to produce and attractive for commercial utility.

BRIEF DESCRIPTION OF THE DRAWINGS

The invention will be more further understood when considered with the following drawings which are given by way of illustration only, and thus are not limitative of the present invention, and wherein.

SPECIFIC DESCRIPTION OF THE INVENTION

Figure 1:
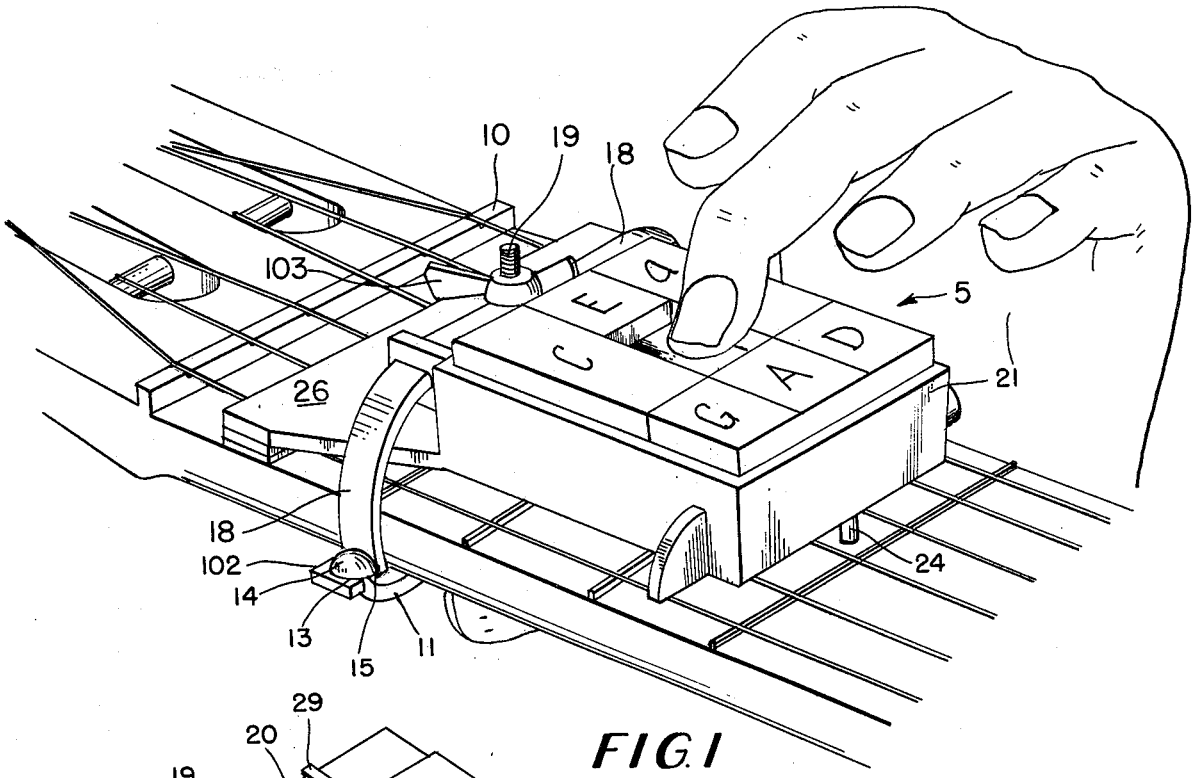
FIG. 1 is a general perspective view showing the device of the present invention fitted to a guitar.

Referring now to FIG. 1 there is seen the accompanying device of the present invention in its attached configuration to the neck of a guitar. The accompanying device generally designated 5 comprises selector keys represented by the lettered numbers housed within a container 21. At one end of the container is situated a capotasto (capo) designated 25 which acts as a bar and extends horizontally across the neck of the guitar so as to depress all of the strings of the guitar against the surface of the neck. A point support in the form of a pin 24 is positioned at the opposite end of the container away from the capo situated at the center line of the neck to which the container is attached. The pin extends about 5 mm downward from the lower plane or bottom of the container. This pin is placed between the third and fourth strings of the instrument before tightening the containers prolongation 26 at the capo end which provides for securing the container 21 to the neck of the string instrument by way of the tightener arms 18 via screw 19 and thumb screw 103. The tightener arms 18 are two curved metal plates of the same form and dimension which are secured at one end by screw and thumb screw combination discussed above and at the other where each terminates at a 90° bend designated 102 whereat they are secured by band 11 which is introduced through opening 15 into circular slot 13 having a diameter larger than that of a band thickness but smaller than that of the tightening band ball 14.

Figure 2:
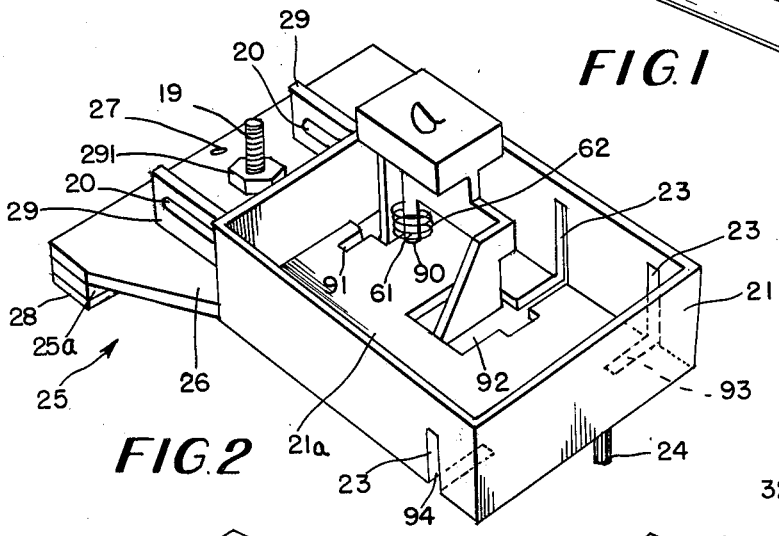
FIG. 2 is a perspective view showing the accompanying device of the present invention excluding the means for securing the device to the instrument and wherein selector "a" is represented in an operating position with the remaining selectors being excluded for illustrative purposes.
Figure 3:
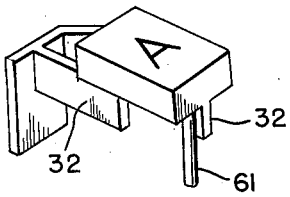
FIGS. 3 through 8 are perspective views of the selector keys of the accompanying device of the present invention.
Figure 4:
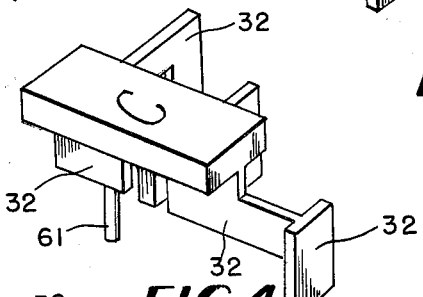
Figure 5:
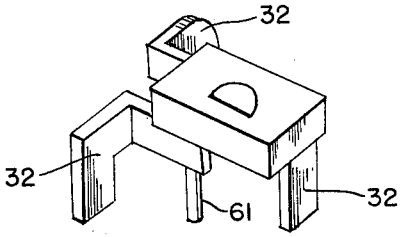
Figure 6:
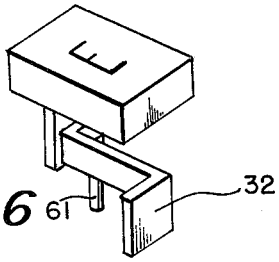
Figure 7:
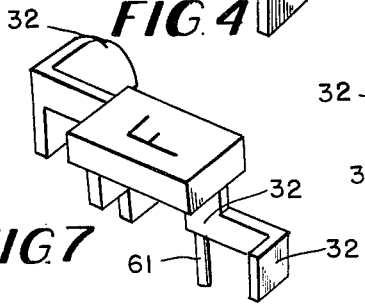
Figure 8:
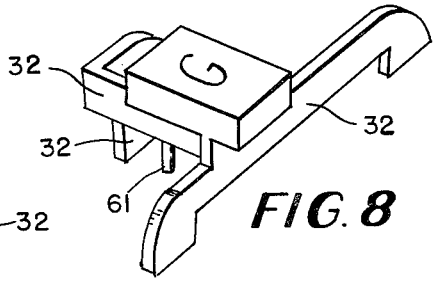

Referring now to FIG. 2, the container is represented as being attached from the neck of the guitar so as to provide a more open view of the inner portion thereof with only one selector key corresponding to note "a" being represented diagrammatically for purposes of this explanation. Again, as seen in FIG. 2, the container 21 has a bottom or lower plane represented as **21*a* having holes therein and designated 91, 92, 93 and 94 for receiving the extensions of the selector keys when they are depressed, which in turn contact the strings on the neck of the instrument. Holes 90 receive the projections 61 of the selector keys and springs 62 keep the keys in their nonengaging position. On the lateral walls of the container there are four additional holes identified as 23, three of which are seen in FIG. 2, to permit the selector's elongations laterally to pass out of a container to engage strings 1 or 6. This is more diagrammatically represented in FIG. 9. Pin 24 discussed above is preferably placed between the third and fourth strings of the instrument prior to tightening the devices fixing screw 103. This is a convenient place to check the correct alignment of the device. The pin should be nearest to and back of the corresponding chosen fret. The pin 24 may be either circular or rectangular in section and is generally, but not necessarily, fabricated as an integral part of the container. The prolongation 26 measuring from the capo end of the container is generally about 33 mm long in order to provide the required distance for the positioning of the capo 25 over the strings. The capo 25 comprises a metal plate 25 about 3×5×60 mm affixed by means of a rivet 27 at a central point to the prolongation and transversely aligned to the next center line. The capo 25 has a rubber or plastic plate 28 of the same measurements of the metal bar 25*a* in order to provide a cushioned contact with the instrument's strings. The object of a portion of the capo being made of metal is to permit its bending by the user so as to provide a better fit to the laterally curved string boards of some guitars, such as electric guitars. The container prolongation 26 also has two vertical parallel plates 29 aligned with the center line of the neck shown in FIGS. 2 and 10 and affixed to its upper surface, having slots 20 for insertion of the tightener arms 18. For purposes of the illustration, the parallel plates measure about 2×13×15 mm and when the container is fabricated of plastic, the parallel plates are fabricated integral therewith. If the structure is one of metal, then the plates are attached by means of rivets. The plates are about 25 mm apart. The slots 20 measure about 3×10 mm to allow the passage of the above stated tightener arms 18. The fixing screw 19 is represented inserted upwards through a hole in the prolongation at the center line about 16 mm from the body of the container. Lock nut 291** is utilized to fasten the screw against the container prolongation. The container may be made of plastic or metal and generally will measure 65×47×29 mm.

FIGS. 3 through 8 represent the configuration of each of the individual selector keys corresponding to the respective melody or chord represented by the appropriate letter. The projections of the selector key 32 contact the strings and provide the harmonic effect. Projections 61 provide the vehicle for the spring 62 discussed with respect to FIG. 2 which returns the respective selector to its original position after the appropriate pressure has been released.

Figure 9:
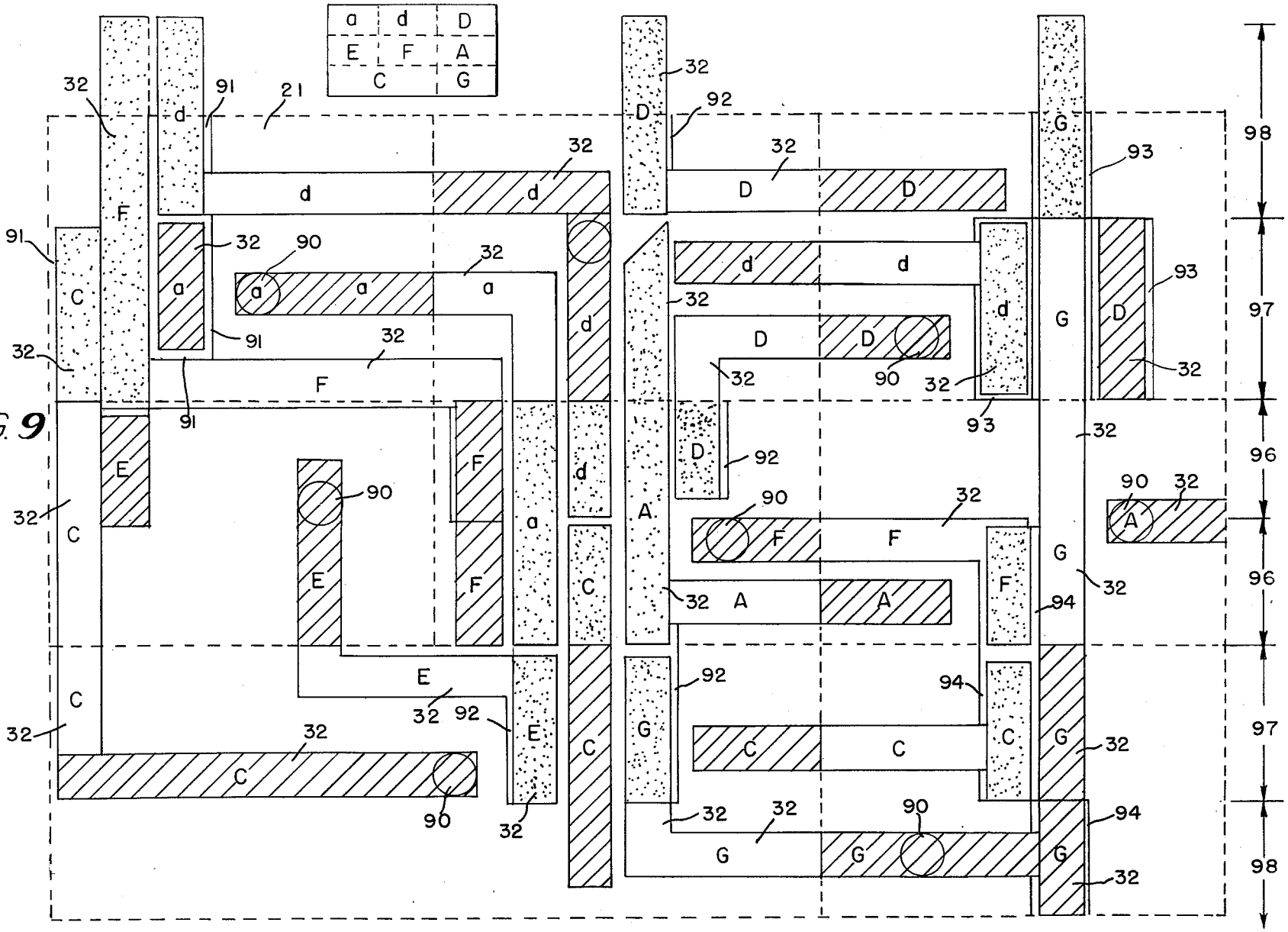
FIG. 9 is a diagrammatic plan view of the bottom plane portion of the configuration of FIGS. 1 and 2 illustrating the functional aspects of the selector keys when depressed.

Referring now to FIG. 9, there is seen a plan view of the lower plane of the container diagrammatically representing the functionality of the accompanying device. The ideal line of action for the string stoppers measured longitudinally from the capo are located respectively at distances of 28, 53 and 78 mm in order to fit the majority of fret separations found in most guitars. The size of the fret separations being variable, the string separations are also variable. These string separations being variable, in order to cover all of the possible positions where strings can be located in a particular guitar transverse to the next center line, the location of the strings engaging the surfaces of the selectors are to be measured as follows. To cover the third and fourth strings, 7.5 mm from the center line as represented by numeral 96, to cover the second and fifth strings, 9.0 mm continuing from the last measurement outward as illustrated by 97 and to cover the first and sixth strings, 11.0 mm outward as illustrated by 98. Thus, every possible separation of strings in any guitar will be reachable by the selector keys of the device of the present invention. As discussed above and further illustrated in FIG. 9, the device has four groups of holes 91 serving strings 1, 2 and 3 at the first fret, 92 serving strings 1 through 5 at the second fret, 93 serving strings 1 and 2 at the third fret and 94 serving strings 4, 5 and 6 at the third fret. The groups of holes take the dimensions of the thickness of the selectors times the number of concurrent selectors. Its lateral measurements 7.5, 9 and 11 mm starting from the center line are discussed immediately above. The remaining group of holes 90, which are circular in shape and eight in number receive and are of the same diameter as the corresponding projections 61, about 2 mm. Each key is appropriately identified at its contact portion 32 by the corresponding letter designation. The diagrammatic view represented by FIG. 9 demonstrates that every elongation reaches the point where its corresponding strings are to be engaged no matter the difference in separations and are nearest to the line of possible position of the frets. The areas below the selector keys where the elongations are, are identified by stripped zones. The elongations extending below other different selectors are indicated by two parallel lines. The lower edges of the selectors destined to find and engage the strings are indicated by dotted spaces. All of the elongations are marked as stated above by the letters of its corresponding chord or selector. The elongations that work as spring rulers are identified by a circle. The black zone around the dotted areas indicate the contours of the holes. The dotted lines show the contour of the keys. The diagrammatic view is set out in a scale of 4 to 1.

Figure 10:
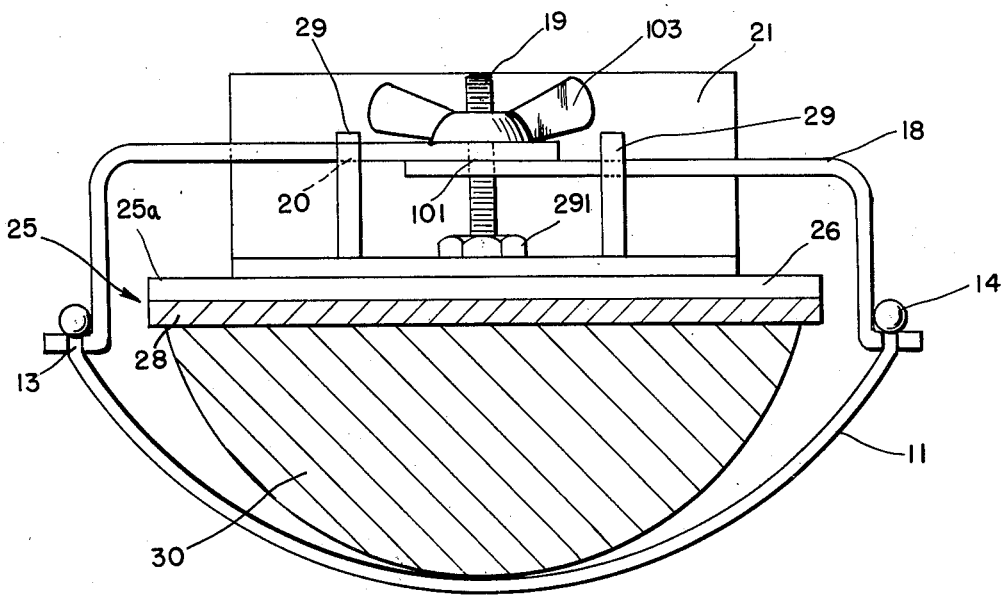
FIG. 10 is an end sectional view of the attachment for fixing the accompanying device of the present invention to a perspective string instrument.

FIG. 10 represents the means for fixing the accompanying device of the present invention to the neck of the particular string instrument. Tightening arms 18 interlock across the center line and are fastened by screw 19 inserted through hole 101 and secured by thumb screw 103. Locking nut 291 fixes the screw 19 to the projection 26. Capo 25 comprising a metal plate 25*a* and stop 28 is represented in contact across the transverse surface of the neck of the sectioned string instrument 30. The band 11 forms the lower support which is secured by the band ball 14 via slot 13. To proceed to assemble the tightener arms, the screw 19 is appropriately introduced to its working position and lock nut 291 tightened to half its run. Then the arms 18 are introduced through the pivot holes 20 until reaching the screw with its holes 101. When this is accomplished the tightening of the lock nut 291 and thumb screw 103 is completed to secure the device. The band 11 is a flexible configuration made of plastic or similar material held in place by the band balls discussed above.

Figure 11:
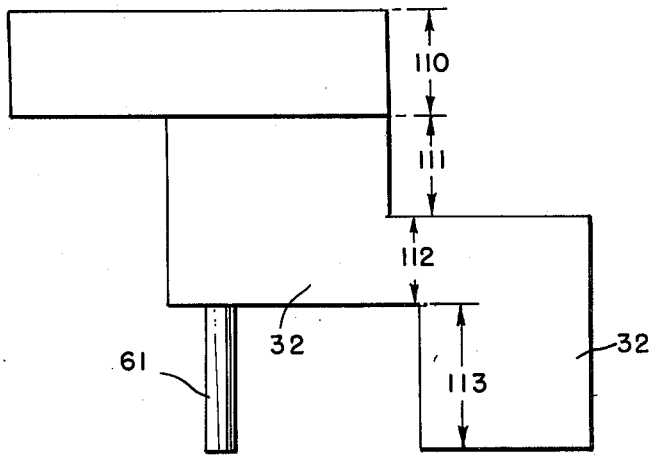
FIG. 11 is a side view representing the general overall dimensions of the selector keys of the present invention.

Referring now to FIG. 11, there is seen a cross-section of a representative selector key of the present invention. The elongations of the selectors transmit the pressure from the finger to the strings selectively. All the elongations of the keys have the same measurements when vertically seen as in FIG. 11. The finger contact portion is represented by 110. The vertical extension 32 is divided into sections 111, 112 and 113. Section 111 of the vertical extension 32 will measure about 11 mm from the solid body of the selector key 110. The elongation then extends laterally to reach the point where the pressure is to be applied. The height of the lateral extension 112 measures about 5 mm until a point where the elongation again extends downward where the point of applied pressure is reached. This downward extension 113 measures about 9 mm so as to reach the string without being restricted by the lower plane of the container. Extension 61 is further identified and has been discussed above.

There are two kinds of tones, major and minor. Every major has a minor relative. All major tones are formed by its tonic tone, its dominant tone, its subdominant tone and its supertonic tone. The minor relative tone, meanwhile, is formed by its tonic minor, its dominant major, its subdominant minor and its major tone. Besides these there is one more tone to complete the group, that is the doric tone most used in the 17th century, but has become fashionable again. Since there is a relative relationship between a major and a specific minor tone, most music is written using a combination of tones from both groups. For that reason the accompaniment has to be performed by using chords that comply with the relationship and relativeness, rigidly stipulated by harmony rules. Thus far, complete tones used in the Western world of music are formed by tonic major, dominant major, subdominant major, supertonic major, minor tonic relative, major dominant relative, minor subdominant relative, major tonic relative and doric tone. Very few songs would require a specific tone not included here and for functional reasons they do not justify consideration. All these tones are absolutely necessary to be available in order to perform accompaniments for any kind of music and several of these complete groups are absolutely necessary to be able to perform accompaniments at different voice heights. There are musical rules to designate chords to integrate tones based on intervals from the principle chord which names the group. The following are the results of the application of set rules to six of the first tones.

| | | | | FIRST TONES | | | | | |
|---|---|---|---|---|---|---|---|---|---|
| NAME OF TONE | TONIC MAJOR | DOMIN MAJOR | SUBDO MAJOR | SUPER MAJOR | MINOR TONIC RELAT | MAJOR DOMIN RELAT | MINOR SUBDO RELAT | MAJOR TONIC RELAT | DORIC TONE |
| C Major | C Maj | G Maj | F Maj | D Maj | a min | E Maj | d min | A Maj | e min |
| C#Major | C#Maj | G#Maj | F#Maj | D#Maj | a#min | F Maj | d#min | A#Maj | f min |
| D Major | D Maj | A Maj | G Maj | E Maj | b min | F#Maj | e min | B Maj | f#min |
| D#Major | D#Maj | A#Maj | G#Maj | F Maj | c min | G Maj | f min | C Maj | g min |
| E Major | E Maj | B Maj | A Maj | F#Maj | c#min | G#Maj | f#min | C#Maj | g#min |
| F Major | F Maj | B#Maj | A#Maj | G Maj | d min | A Maj | g min | D Maj | a min |

This procedure continues, half to half tones, through six more tones making a total of twelve, which constitutes the whole harmonic spectrum. As can be seen, some chords are present in different rows more than once. This happens because any specific chord performs a specific role when it is conceived as a member of a specific tone and another different role when it appears into a different family or tone and it is distinguished by the mentioned intervals or number of half tones from the tone chord. This all implies that what really matters in designing an accompaniment sequence is the correct selection of roles to be performed by the chords into a tone and not simply of chords. It is done in other words on the basis of tone consideration. The present device of this invention has been designed toward that end. Any device which fails to consider the above is only a chord player and does not satisfy the requirements of the present invention.

The key selectors of the accompanying device are eight in number, and each has on its upper surface a letter obliquely oriented in order to provide for easy reading by the user. Said letters are as follows: a, A, C, d, D, E, F and G. These letters have been used to represent the real chords produced when the device is positioned at its top position, that is over the capo fret 10 identified in FIG. 1. When the device is placed at different frets, the actual chords that will be produced will be different from the letters indicated. This variation of actual chords produced will follow fret to fret, the same sequence as indicated in the chart of tones or groups of chords set forth above. However, as the procedure of performing accompaniments is actually accomplished by following sequences of interrelated tones or chords as members of a family, the following precedure is the same sequence, for any tone. This means that once a sequence is learned it is the same no matter which height of the neck has been chosen for playing. Furthermore, the tone of C major, utilized to name the selector, is a good reference family because it is the most used tone and the one that is most frequently found in song books. It is important to know that actual names of the chords only when playing with orchestras or music bands. When playing as an amateur it is only important to fit the singing voice adequately no matter what are the names.

The letters "a" and "d" express minor chords and the rest of the letters are for major tones. The roles each selector project into the complete tone are as follows: C: tonic major, G: dominant major, F: subdominant major, D: supertonic major, a: minor tonic relative, E: major dominant relative, d: minor subdominant relative, A: major tonic relative and e: doric tone. All selectors have a key type upper body. Seven of them have exactly the same dimensions, with only C being different in length. All of the keys measure about 15 mm wide and 6 mm high. All except C have a length of 21 mm with C being twice as long. The reason for C being twice as long is to accommodate the interior laberinth problem and it is useful to distinguish the principle tone or tonic tone from the rest of the tones. The reason for the specific dimensions of the width and height of the selectors is to provide an efficient and easy application of pressure by the fingers and permit the selectors being moved into a completely ruled run by means of the surfaces of other selectors and the container. The required run is less than 6 mm provided. The selectors are positioned so as to reach the corresponding strings of the corresponding frets, and placed nearest to the center of application of the resultant force to the applied strings. In this manner the pressure applied to the strings is equally distributed. The preferred material utilized for the body and elongation portion of the selectors is generally considered plastic since the material is easily molded by means of a matrix for plastic injection. However, metal plates may be used with good results.

The invention being thus described, it will be obvious that the same will be varied in many ways. Such variations are not to be regarded as a departure from the spirit and scope of the invention and all such modifications as would be obvious to one skilled in the art are intended to be included in the scope of the following claims.

What is claimed is:

1. An accompanying device for a stringed musical instrument having a neck with frets spaced longitudinally thereon and strings spaced laterally thereacross comprising in combination a container slidably mounted on said neck for positioning longitudinally along said strings at different fret positions, said container having disposed therein a group of selector keys for producing musical tones, a means for attaching said accompanying device to the neck of said stringed instrument, said attachment means comprising a flexible band to be tightened about the neck of said string instrument, said flexible band interacting with tightening arms having flat and bent ends, said arms pivoting about respective plates of said container having holes to support said arms, said arms pivoting and exercising their tightening action by pulling on the ends of the flexible band when their straight ends are depressed by a tightening lock nut.

2. The accompanying device as disclosed in claim 1, wherein each of said selector keys has at least one elongation of its body that reaches the respective strings at the corresponding frets so as to produce different musical chords in response to the depression of each of said selector keys.

3. The accompanying device as disclosed in claim 2, wherein each selector key comprises a unitary structure integrally placed within said carrier with respect to the remaining selector keys such that the elongations which stop the strings are independent of each other.

4. The accompanying device as disclosed in claim 2, wherein said container comprises a box like structure, the top portion thereof being open for insertion of the selector keys and the bottom portion thereof comprising a plane structure having openings therein for selective passage of the elongations of said selector keys.

5. The accompanying device as disclosed in claim 2, wherein each selector comprises a key type upper body and vertical elongations extending therefrom which transmit pressure from the key type upper body to the strings selectively, all of said elongations having the same vertical measurement, each selector having the necessary vertical elongations corresponding to the respective chord it is designed to reproduce upon the application of pressure to said upper body.

6. The accompanying device as disclosed in claim 5, wherein the respective selector keys further include a secondary elongation which functions as a spacer around which is positioned a spring which initially maintains the selectors in their nonengaging position and upon depression and release returns the respective selector to its starting position.

7. The accompanying device as disclosed in claim 1, wherein said group of selector keys numbers eight.

* * * * *